US007247781B2

(12) United States Patent
Ikeya

(10) Patent No.: US 7,247,781 B2
(45) Date of Patent: Jul. 24, 2007

(54) INTERACTIVE MUSIC APPLICATION APPARATUS AND ELECTRONIC MUSICAL INSTRUMENT AND PROGRAMS THEREFOR

(75) Inventor: Tadahiko Ikeya, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 414 days.

(21) Appl. No.: 10/746,380

(22) Filed: Dec. 23, 2003

(65) Prior Publication Data

US 2004/0173081 A1 Sep. 9, 2004

(30) Foreign Application Priority Data

Dec. 27, 2002 (JP) ..... 2002-381546

(51) Int. Cl.
*G10H 1/00* (2006.01)

(52) U.S. Cl. ..... 84/600; 709/225; 710/16

(58) Field of Classification Search ..... 709/227, 709/228, 203, 225; 710/7–10, 16, 15; 84/600
See application file for complete search history.

(56) References Cited

U.S. PATENT DOCUMENTS 5,296,641 A * 3/1994 Stelzel ..... 84/602
5,749,577 A * 5/1998 Couch et al. ..... 273/148 B

FOREIGN PATENT DOCUMENTS

JP 5188935 7/1993
JP 3058051 11/1996

OTHER PUBLICATIONS

The Complete MIDI 1.0 Detailed Specification. The MIDI Manufacturers Association. 1996. See pp. T-11 throught T-13.*

* cited by examiner

*Primary Examiner*—Lincoln Donovan
*Assistant Examiner*—David S. Warren
(74) *Attorney, Agent, or Firm*—Morrison & Foerster LLP

(57) ABSTRACT

Electronic musical instrument interactively connected with a music application apparatus automatically returns a response signal when a predetermined identification request signal is received from the music application apparatus. Upon receipt of the response signal transmitted by the musical instrument in response to the identification request signal, the application apparatus determines whether or not the connected musical instrument is of a predetermined identity. Thus, for each electronic musical instrument authorized to execute the music application, the application apparatus can perform control to allow the music application to be executed in a normal mode, while, for each electronic musical instrument not authorized to execute the music application, the application apparatus can perform control to inhibit the application from being executed or allow the application to be executed only in a limited function mode.

9 Claims, 3 Drawing Sheets

INTERACTIVE MUSIC APPLICATION APPARATUS AND ELECTRONIC MUSICAL INSTRUMENT AND PROGRAMS THEREFOR

BACKGROUND OF THE INVENTION

The present invention relates to an improved music application apparatus for causing a music application software (hereinafter referred to as a "music application") to progress on the basis of information pertaining to operation of performance operators on an electronic musical instrument connected with the music application apparatus, an improved electronic musical instrument capable of operating in an interlocked relation to the music application caused to progress by the music application apparatus, and computer programs for the music application apparatus and electronic musical instrument.

Music application apparatus have been known, which allow users to enjoy music applications that also have functions of providing a guide as to how to use an electronic musical instrument and providing music piece performing lessons. For example, a music application apparatus (in the form of a personal computer), disclosed in Japanese Patent No. 3,058,051, is connected via a MIDI interface etc. to an electronic musical instrument. The disclosed music application apparatus prompts a user to operate performance operators on the electronic musical instrument, by executing a music game (music application) designed to sequentially display performance operators of the electronic musical instrument, to be operated in accordance with a progression of a given music piece, using character images etc. Specifically, images of performance operators, such as keys of a keyboard, are visually displayed on a display screen so that a human player or user can immediately know which of the keys should be depressed or operated, but also notes of a melody of a given music piece are displayed, for example, in character images of "apples" in such a manner that the "apples" sequentially fall down to a bottom portion of the display screen in accordance with a progression of the given music piece. As the player operates any one of the performance operators (e.g. keyboard keys) of the electronic musical instrument, connected with the music application apparatus, in accordance with the corresponding falling "apple" reaching a predetermined position on the display screen, an image of an "arrow" shot toward the falling "apple" is displayed on the screen. If the human player has operated the performance operator at proper timing, the "arrow" is displayed on the screen as having successfully hit the target "apple", and a score count is incremented accordingly. If, on the other hand, the human player has failed to operate the performance operator at proper timing, then the "arrow" is displayed on the screen as having missed the target "apple" and, in this case, the score count is not incremented. In the disclosed music application apparatus, the above procedures are carried out as a kind of "music game". With the thus-arranged music application apparatus, the human player can readily learn how to use the functions of the electronic musical instrument connected with the music application apparatus, how to manipulate the performance operators for a desired music piece, etc. while enjoying the music game or music application.

Further, in recent years, it has been generally common to package a music application together with an electronic musical instrument of a particular manufacturing company, with a view to promoting sales of the electronic musical instrument of the particular manufacturing company or of a particular model. However, heretofore, even a same music application, provided for sales promotion of an electronic musical instrument of a particular manufacturing company (or a particular model), was allowed to operate in a full function mode (i.e., without significant functional limitations) with not only the electronic musical instrument of the particular manufacturing company (or particular model) but also an electronic musical instrument of any other manufacturing company than the particular manufacturing company (or another model than the particular model). Namely, even where a music application was provided for sales promotion of an electronic musical instrument of a particular manufacturing company, the music application was permitted to appropriately operate with an electronic musical instrument of another manufacturing company in generally the same manner as with the electronic musical instrument of the particular manufacturing company. In such a case, there would be encountered the problem that the provision of the music application could not effectively lead to a differentiation between the electronic musical instruments of the particular manufacturing company and other manufacturing company and hence hardly contribute to sales promotion of the electronic musical instrument of the particular manufacturing company.

As one possible approach for avoiding the problem, the music application may be arranged to not work at all when an electronic musical instrument of another manufacturing company than the particular manufacturing company is operatively connected with the music application. However, in the case where the music application is arranged to not work at all when the electronic musical instrument of the other manufacturing company is connected, there would be caused another inconvenience that superior functions etc. of the electronic musical instrument of the particular manufacturing company can not be effectively presented at all to potential users through actual functionality comparisons with the electronic musical instrument of the other manufacturing company, so that the potential users desiring to ascertain the functions of the electronic musical instrument of the particular manufacturing company prior to purchase are often left unconvinced of advantages of the electronic musical instrument of that company.

SUMMARY OF THE INVENTION

In view of the foregoing, it is an object of the present invention to provide: an improved music application apparatus which can automatically determine whether an electronic musical instrument connected therewith is of a particular manufacturing company (or particular model) or of another manufacturing company than the particular manufacturing company (or another model than the particular model) and thereby allows a music application to progress differently between a case where the electronic musical instrument of the particular manufacturing company (or particular model is connected with the music application apparatus and a case where the electronic musical instrument of the other manufacturing company or other model is connected with the music application apparatus; an improved electronic musical instrument capable of operating in an interlocked relation to the music application executed by the music application apparatus; and computer programs for use in the improved music application apparatus and electronic musical instrument.

According to one aspect of the present invention, there is provided a music application apparatus interactively operable by being connected with an electronic musical instrument, which comprises: a transmission/reception section that transmits a predetermined identification request signal to the electronic musical instrument connected with the music application apparatus and receives a response signal returned by the connected electronic musical instrument in response to the predetermined identification request signal; a determination section that determines, on the basis of the response signal received by the transmission/reception section, whether or not the connected electronic musical instrument is of a predetermined identity; and a control section that causes the music application to progress normally in response to performance-operator-operation-related information given by the connected electronic musical instrument when the determination section has determined that the connected electronic musical instrument is of the predetermined identity, but does not at all cause the music application to progress or causes the music application to progress only in a limited function mode when the determination section has not determined that the connected electronic musical instrument is of the predetermined identity.

According to another aspect of the present invention, there is provided an electronic musical instrument interactively operable by being connected with a music application apparatus, which comprises a response section that, when a predetermined identification request signal is received from the music application apparatus, returns a response signal indicative of a preset identity of the electronic musical instrument to the music application apparatus. In this invention, that the electronic musical instrument is of a predetermined identity is an essential condition for allowing a music application to progress normally on the music application apparatus.

According to the present invention, the identity of the electronic musical instrument is determined on the basis of the response signal received from the electronic musical instrument and indicative of the identity of the musical instrument, and different music-application progression control is performed for each different identity determined in this manner. The response signal is a signal automatically returned by the electronic musical instrument to the music application apparatus when the predetermined identification request signal has been received from the music application apparatus. Namely, in response to the predetermined identification request signal received from the music application apparatus, the electronic musical instrument automatically returns the response signal indicative of the preset identity of the electronic musical instrument to the music application apparatus. Upon receipt of the response signal from the electronic musical instrument, the music application apparatus determines whether or not the connected musical instrument is of a predetermined identity authorized to execute the music application. Thus, for each electronic musical instrument authorized to execute the music application, the application apparatus performs control to allow the music application to be executed in a normal mode, while, for each electronic musical instrument not authorized to execute the music application, the application apparatus performs control to inhibit the application from being executed or allow the application to be executed only in a limited function mode. Thus, the present invention can provide a music application operable in a full function mode (i.e., with no functional limitations) only with an electronic musical instrument of a particular manufacturing company or of a particular model which is compliant with the music application. As a result, the present invention advantageously achieves a sufficient differentiation between electronic musical instruments of a particular manufacturing company and other manufacturing company (or of the particular model and other model).

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE EMBODIMENTS

First, a description will be given about an exemplary general setup of a music application apparatus and electronic musical instrument constructed in accordance with an embodiment of the present invention.

Figure 1:
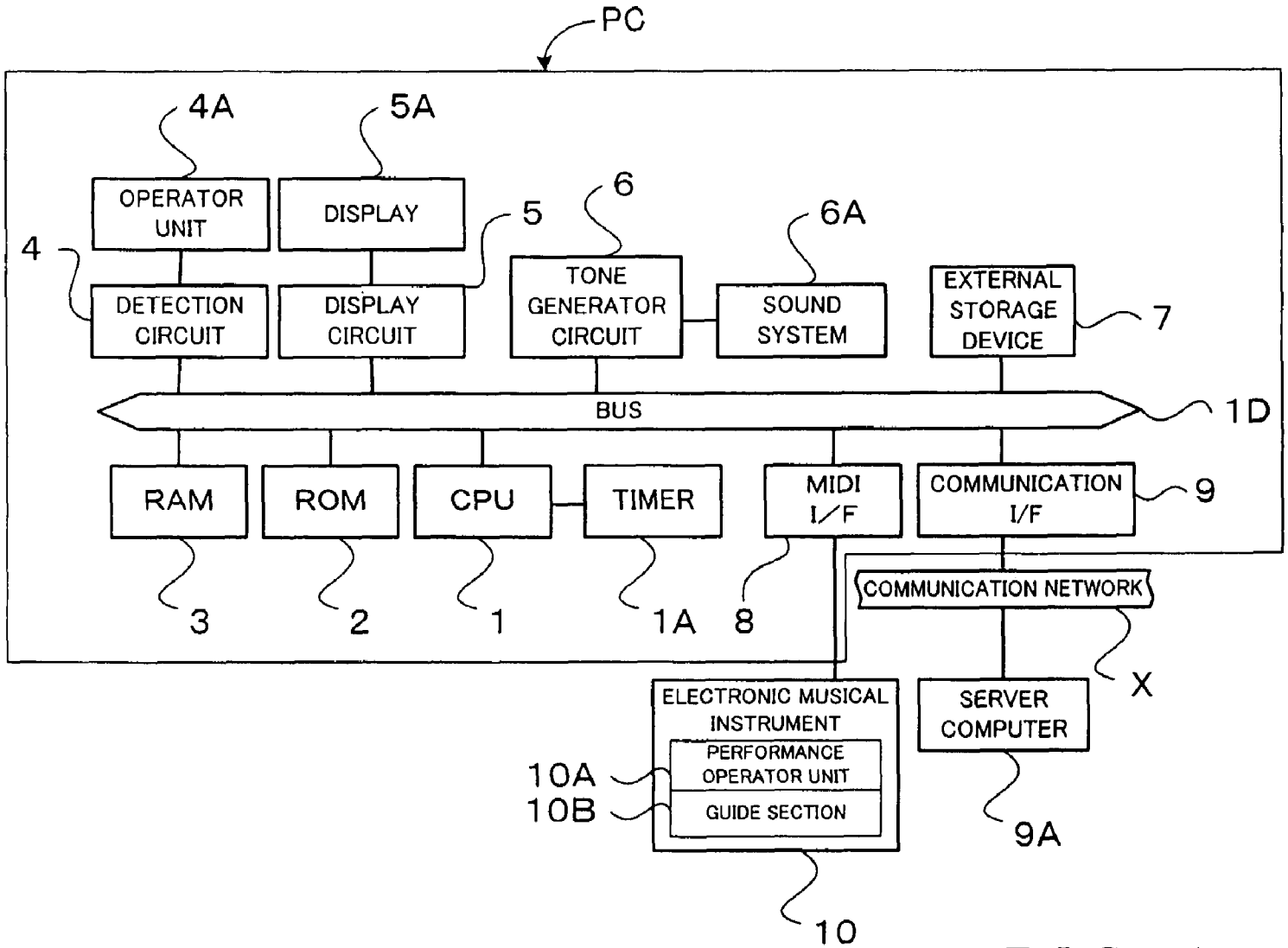
FIG. 1 is a block diagram explanatory of a general hardware setup of embodiments of a music application apparatus and an electronic musical instrument.

FIG. 1 is a block diagram of a general hardware setup of the music application apparatus generally denoted by reference character "PC". The electronic musical instrument 10 connected with the music application apparatus PC can be constructed using generally the same hardware as the application apparatus PC. Thus, a description of the hardware construction of the musical instrument 10 is omitted, and the following description will be made representatively using the hardware block diagram of the music application apparatus PC shown in FIG. 1.

The music application apparatus PC of FIG. 1 is in the form of a personal computer (PC), where processes for executing the music application are performed by the computer running predetermined control programs, such as a music game processing program (to be later detailed) and other software programs. Needless to say, these processes may be performed by microprograms executed by a DSP (Digital Signal Processor) rather than by the computer software. Alternatively, the processes may be performed by a dedicated hardware apparatus including discrete circuits, integrated circuitry or large-scale integrated circuitry, rather than by the software. It should be appreciated that the music application apparatus of the present invention is an apparatus for executing any of music-performance-related applications, such as applications providing a music game, music lessen and musical production, and may be in the form of any other suitable product than the personal computer (PC), such as a dedicated game apparatus, portable terminal like a portable (e.g., cellular) phone or PDA (Personal Digital (Data) Assistant), karaoke apparatus or other multimedia equipment.

The music application apparatus PC of FIG. 1 is controlled by a microcomputer that comprises a microprocessor unit (CPU) 1, a read-only memory (ROM) 2 and a random-access memory (RAM) 3. The CPU 1 controls all operations of the music application apparatus PC. To the CPU 1 are connected, via a data and address bus 1D, the ROM 2, RAM 3, detection circuit, display circuit 5, tone generator (T.G.) circuit 6, external storage device 7, MIDI interface (I/F) 8 and communication interface 9. Also connected to the CPU 1 is a timer 1A for counting various time periods, for example, to signal interrupt timing for a timer interrupt process. For example, the timer 1A generates tempo clock pulses, which are given to the CPU 1 as processing timing instructions or as interrupt instructions. The CPU 1 carries out various processes in accordance with such instructions.

The ROM 2 has prestored therein various programs to be executed by the CPU 1 and various data to be referred to by the CPU 1. The RAM 3 is used as a working memory for temporarily storing various data generated as the CPU 1 executes a predetermined program, as a memory for storing the currently-executed program and data related thereto, and for various other purposes. Predetermined address regions of the RAM 3 are allocated to various functions and used as registers, flags, tables, etc. Operator unit 4A comprises, for example, a numeric keypad for entering numerical value data, a keyboard for entering character and text data, a mouse for operating a predetermined pointing element displayed on a display 5A, and/or special switches; the operator unit 4A may be in any desired form. The detection circuit 4 constantly detects respective operational states of the individual operators on the operator unit 4A and outputs switch information, corresponding to the detected operational states of the operators, to the CPU 1 via the data and address bus 1D. The display circuit 5 not only visually displays a music game screen on a liquid crystal display (LCD), cathode ray tube (CRT) or the like in the conventional manner as set forth earlier, but also displays various information pertaining to a music piece selected as the subject of a music game and controlling states of the CPU 1 etc.

The tone generator (T.G.) circuit 6, which is capable of simultaneously generating tone signals in a plurality of channels, receives music piece data of the MIDI standard (MIDI data) supplied thereto via the data and address bus 1D and generates tone signals (e.g., signals of background music tones and effect sounds like a target hitting sound) on the basis of the received music piece data. Each of the tone and sound signals thus generated by the tone generator circuit 6 is audibly reproduced or sounded by a sound system 6A including an amplifier, speaker, etc. The tone generator circuit 6 and sound system 6A may be constructed in any desired conventionally-known manner. For example, any desired tone signal synthesis method may be used in the tone generator circuit 6, such as the FM, PCM, physical model or formant synthesis method. Further, the tone generator circuit 6 may be implemented by either dedicated hardware or software processing performed by the CPU 1.

The external storage device 7, such as a hard disk, is provided for storing control programs and data relating to control of various programs executed by the CPU 1. Where a particular control program is not prestored in the ROM 2, the control program may be stored in the external storage device (e.g., hard disk device) 9, so that, by reading out the control program from the external storage device 7 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 7 may use any of various removable-type media other than the hard disk (HD), such as a flexible disk (FD), compact disk (CD-ROM or CD-RAM), magneto-optical disk (MO) and digital versatile disk (DVD). Alternatively, the external storage device 7 may use a semiconductor memory.

The MIDI interface (I/F) 8 is an interface provided for receiving or delivering MIDI data from or to the electronic musical instrument 10 externally connected with the music application apparatus PC. Either an electronic musical instrument of a particular manufacturing company or particular model, or an electronic musical instrument of any other manufacturing company than the particular manufacturing company or other model than the particular model can be connected via the MIDI interface 8 with the music application apparatus PC, so that a user can enjoy a music application, such as a music game application, through exchange of various information between the music application apparatus PC and the electronic musical instrument 10. Note that the MIDI interface 8 may be a general-purpose interface rather than a dedicated MIDI interface, such as RS232-C, USB (Universal Serial Bus) or IEEE1394, in which case other data than MIDI event data may be communicated at the same time.

The communication interface 9 is connected to a wired or wireless communication network X, such as a LAN (Local Area Network), the Internet or telephone network, via which it may be connected to a desired sever computer 9A so as to input a control program and various data to the music application apparatus PC. Thus, in a situation where a particular control program and various data are not contained in the ROM 2, external storage device 7 or other storage device of the music application apparatus PC, these control program and data can be downloaded from the server computer 9A via the communication interface 9. Such a communication interface 9 may be constructed to be capable of both wired and wireless communication rather than either one of the wired and wireless communication.

The electronic musical instrument 10, connected via the MIDI interface 8 with the music application apparatus PC, may be of any desired type (or operating type) as long as it can generate MIDI data in response to manipulation or operation, by the user, of the musical instrument 10. The electronic musical instrument 10 includes, in addition to generally the same hardware components as the music application apparatus PC of FIG. 1, a performance operator unit 10A of a keyboard type, stringed instrument type, wind instrument type, percussion instrument type, gesture type or any other desired structural or operating type. In one embodiment, the electronic musical instrument 10 is in the form of a keyboard including a plurality of keys for selecting pitches of tones to be generated, and key switches corresponding to the keys. The electronic musical instrument 10 (e.g., keyboard keys) can be used not only for a tone performance, but also as input means for selecting a music piece to be used as the subject of the music game. The electronic musical instrument 10 is also provided with a performance guide section 10B that includes performance guiding elements, such as LEDs, operable to inform a human player of operators (e.g., keys) of the performance operator unit 10A to be operated; for this purpose, the guiding elements of the performance guide section 10B are provided in corresponding relation to the operators (e.g., keys) of the performance operator unit 10A. Illumination (turning-on) and deillumination (turning-off) of the performance guiding elements, such as keyboard LEDs, may be performed in accordance with predetermined information, such as MIDI messages, supplied from the music application apparatus PC, in order to provide a performance guide function. Further, each of the electronic musical instrument 10 of FIG. 1 and other electronic musical instruments connectable with the music application apparatus PC is imparted in advance with a predetermined unique identifier indicative of a manufacturing company or model of the electronic musical instrument (e.g., manufacturing company ID or model ID), and the respective identifiers of the connected electronic musical instruments are prestored in the ROM 2.

Figure 2:
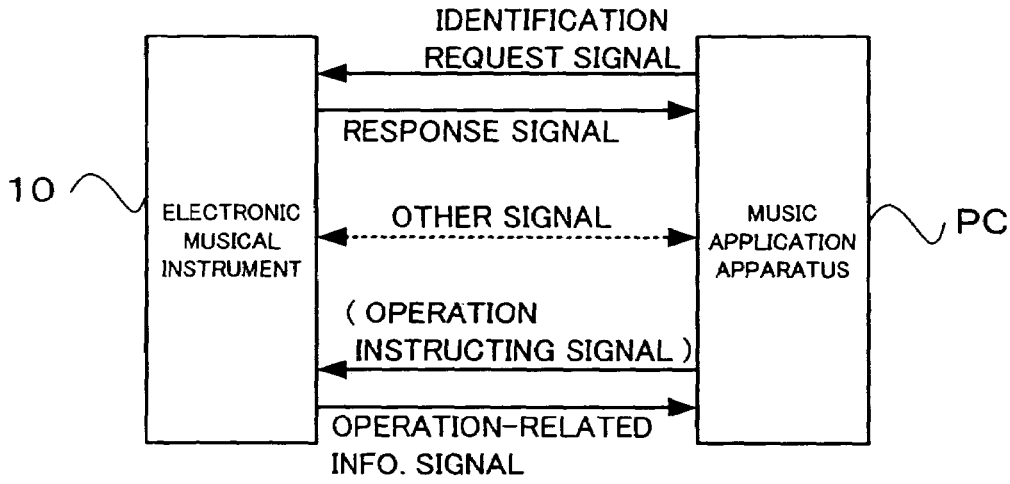
FIG. 2 is a block diagram outlining processing performed by the music application apparatus and the electronic musical instrument connected with the application apparatus.

Next, a description will be given about various processing performed by the music application apparatus PC and electronic musical instrument 10 interactively connected with the music application apparatus PC. FIG. 2 is a block diagram outlining the processing performed by the music application apparatus PC and electronic musical instrument 10.

The music application apparatus PC sends an identification request signal to the electronic musical instrument 10. In response to the identification request signal, the electronic musical instrument 10 returns, as a response signal, an identification signal, indicative of the identity of the electronic musical instrument 10 prestored therein, to the music application apparatus PC. Then, the music application apparatus PC controls a progression of the music application on the basis of the identification signal returned from the electronic musical instrument 10. If the response or identification signal is a predetermined signal, such as one indicating that the electronic musical instrument 10 is a product manufactured by the same company as the music application in question, then the music application of a music game is executed by the music application apparatus PC. During execution of the music game, operation-related information signals are generated in response to user's operation on the performance operator unit 10A of the electronic musical instrument 10 and transmitted from the musical instrument 10 to the music application apparatus PC, so that the music game is caused to proceed or progress in accordance with the performance-operator-operation-related information signals. Of course, other information than the operation-related information, such as MIDI message data, may also be transmitted between the electronic musical instrument 10 and the music application apparatus PC during the execution of the music game. Operation instructing signals, such as those indicative of key codes, may be transmitted from the music application apparatus PC to the electronic musical instrument 10 so that the musical instrument 10 can provide a visual key depression guide by controlling the illumination of the guiding elements of the performance guide section 10B, such as keyboard LEDs, on the basis of the operation instructing signals; thus, the electronic musical instrument 10 can visually indicate, to the human player, operators of the performance operator unit 10A to be operated.

Note that the music application apparatus PC (and the electronic musical instrument 10) should not be construed as limited to a type where all of the operator unit 4A, display 5A, tone generator circuit 6, etc. are incorporated together within the body of the apparatus and may of course be of another type where the above-mentioned components are provided separately and interconnected via communications means such as a MIDI interface, network, etc.

Figure 3:
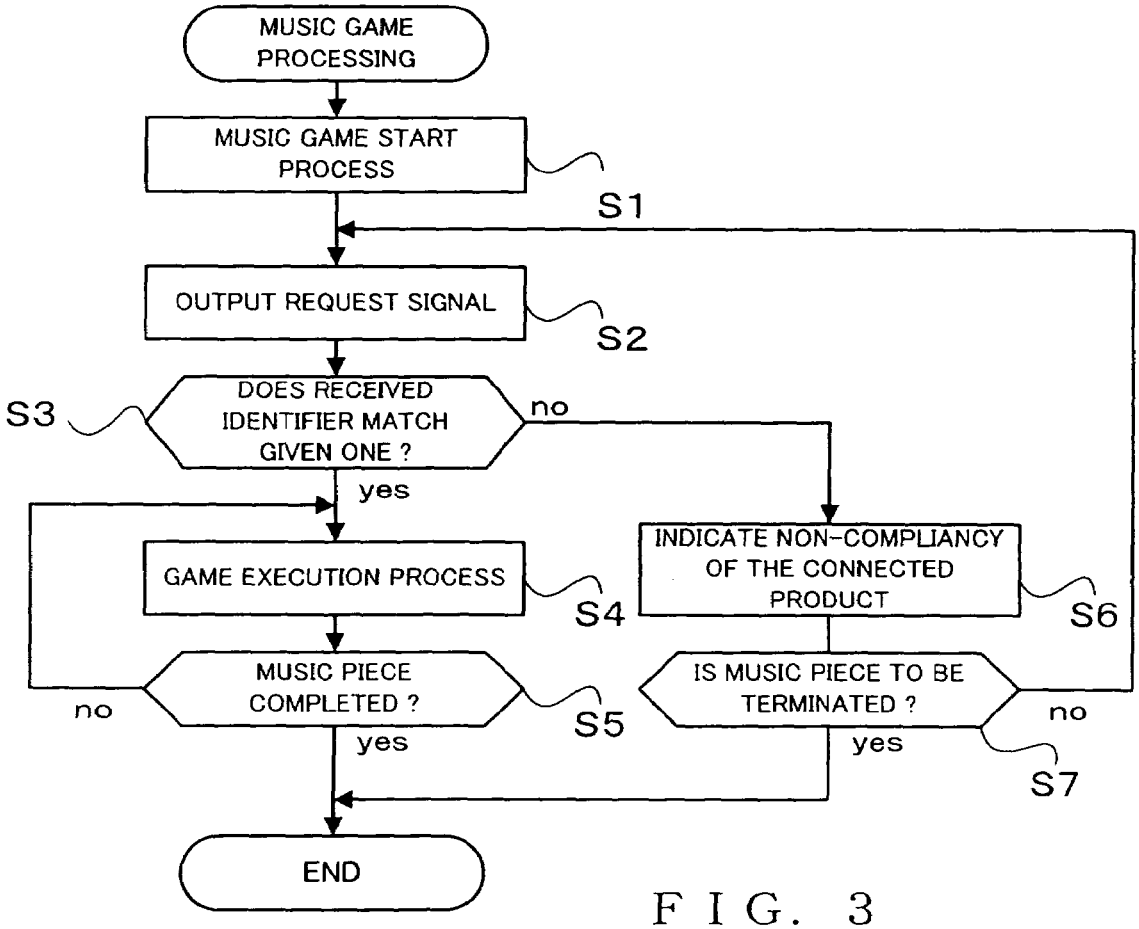
FIG. 3 is a flow chart showing an embodiment of music game processing carried out in accordance with the present invention.

In the instant embodiment, the respective CPUs 1 of the electronic musical instrument 10 and music application apparatus PC execute a predetermined music application software program that provides a music game or the like, so that the music game or the like, similar in form to that set forth above in relation to the prior art technique, can be provided or implemented using these interactive apparatus. The following paragraphs describe music game processing in an exemplary case where the music application is a music game application, with reference to the drawings. FIG. 3 is a flow chart showing one embodiment of the music game processing; to facilitate illustration and explanation, FIG. 3 shows only the music game processing carried out by the music application apparatus PC.

First, at step S1 of FIG. 3, the music application apparatus PC (hereinafter also referred to as a "game apparatus") carries out a "music game start process". For example, the "music game start process" includes a setting operation for making settings for, during execution of the music game, transmitting and receiving various information, such as MIDI message data, to and from the electronic musical instrument 10 connected via the MIDI interface 8 with the game apparatus PC, a display operation for displaying an initial screen of the music game on the display 5A. At a appropriate timing after completion of the "music game start process" (step S1), e.g., immediately after completion of the "music game start process" (step S1) or when any operation on the electronic musical instrument 10 has been made after completion of the "music game start process" (step S1), etc., the game apparatus outputs an identification request signal to the electronic musical instrument 10 connected therewith via the MIDI interface 8, at step S2. The identification request signal is a signal to request the connected electronic musical instrument 10 to send back a predetermined response signal indicative of the identity of the electronic musical instrument 10, with a view to identifying the connected electronic musical instrument 10. As the predetermined response signal, the electronic musical instrument 10 automatically returns to the game apparatus a unique identifier indicative of a manufacturing company or model of the electronic musical instrument 10 (e.g., manufacturing company ID or model ID) that is previously assigned to the instrument 10. Note that some of various electronic musical instruments connectable with the game apparatus are unable to interpret the identification request signal and thus can not return the requested response signal.

Upon receipt of the identifier (response signal) returned from the electronic musical instrument 10 in response to the identification request signal, the game apparatus determines at step S3 whether the received identifier matches any one of a plurality of given identifiers prestored in the game apparatus. If the received identifier matches any one of the prestored given identifiers as determined at step S3, this means that the electronic musical instrument 10 is a product manufactured by the same company as the music game or a product of a particular model that is compliant with the music game in question, so that a "game execution process" is carried out at step S4; namely, the music game is executed by interactive operations of the electronic musical instrument 10 and game apparatus. During the execution of the music game, various information, such as MIDI messages, are communicated between the electronic musical instrument 10 and the game apparatus PC, and each of the apparatus 10 and PC performs predetermined control based on various information. For example, the electronic musical instrument 10 performs various control processes, such as a process for controlling the illumination of the keyboard LEDs (i.e., keyboard LED illumination control process) and a processing for controlling tones and sounds to be generated by the tone generator (i.e., sound generation control process), in accordance with the received MIDI messages. The game apparatus PC performs various processes, such as a process for updating a music game screen (i.e., music screen updating process) in accordance with a progression of the music piece selected as the subject of the music game, a music game scoring process for incrementing a score count in accordance with accuracy of user's operation of keys to be depressed and performance timing of the keys and a process for creating and transmitting MIDI messages to be used for the keyboard LED illumination control and sound generation control. Thus, the music game is caused to progress through the interaction between the electronic musical instrument 10 and the game apparatus PC. At step S5, a determination is made as to whether the performance of the music piece selected as the subject of the music game has been completed. If answered in the negative at step S5, the CPU 1 reverts to step S4 to repeat the above-mentioned "game execution process". If, on the other hand, the performance of the music piece selected as the subject of the music game has been completed as determined at step S5 (YES determination at step S5), a result of the music game is presented to the user or human player, for example, by displaying a final score count of the game obtained by the music game scoring process and/or generating a given effect sound corresponding to the final score count, after which the "music game processing" is brought to an end.

If the received identifier does not match any one of the prestored given identifiers as determined at step S3 (NO determination at step S3), this means that the electronic musical instrument 10, connected via the MIDI interface 8 with the game apparatus, is a product that is not compliant with the music game, such as a product manufactured by a company which is not authorized to execute the music game or a product of another model than a given model. Thus, at step S6, a message is displayed which indicates that the connected electronic musical instrument 10 is a product non-compliant with the music game to be executed on the game apparatus. Example of such a displayed message may be "The connected electronic musical instrument is not a product manufactured by our company and therefore non-usable on this apparatus. Please select re-connecting an electronic musical instrument of our company, or terminating the music game". At next step S7, it is determined whether or not the current music game should be terminated in accordance with the user's selection responsive to the displayed message to the effect that the connected electronic musical instrument 10 is a product non-compliant with the music game. If the termination of the music game has been selected by the user (YES determination at step S7), the "music game processing" is brought to an end so as not to execute the music game. If, on the other hand, the re-connection of an electronic musical instrument manufactured by the same company as the music game has been selected by the user (NO determination at step S7), the CPU 1 reverts to step S2 to repeat the aforementioned operations of steps S2-S7. Namely, when an electronic musical instrument of the same company that is compliant with the music game is connected with the game apparatus in place of the electronic musical instrument of another company that is non-compliant with the music game, the music game is initiated.

Figure 4:
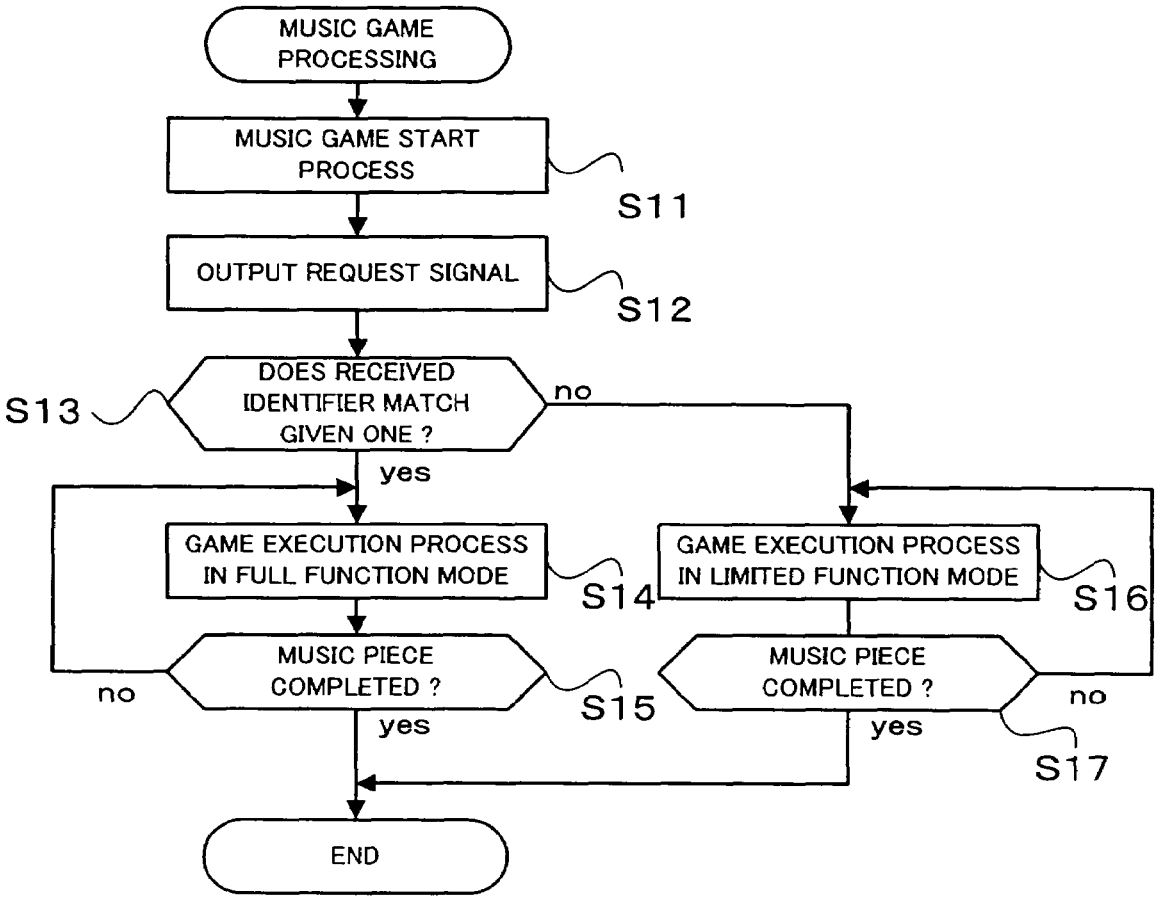
FIG. 4 is a flow chart showing another embodiment of the music game processing.

FIG. 4 is a flow chart showing another embodiment of the music game processing; to facilitate illustration and explanation, FIG. 4 too shows only the music game processing carried out by the music application apparatus or game apparatus PC. Steps S11-S13 in FIG. 4 are directed to operations similar to the above-described operations of S1-S3 in the embodiment of FIG. 3 and thus steps S11-S13 will not be described here.

If the identifier (response signal) received from the electronic musical instrument 10 matches any one of the prestored given identifiers as determined at step S13 (YES determination of step S13), a "game execution process in a full function mode" is carried out repetitively at step S14 until the performance of the music piece selected as the subject of the music game is completed, i.e. until a YES determination is made at step S15. If, on the other hand, the identifier received from the electronic musical instrument 10 does not match any one of the prestored given identifiers (NO determination of step S13), a "game execution process in a limited function mode" is carried out repetitively at step S16 until the performance of the music piece selected as the subject of the music game is completed, i.e. until a YES determination is made at step S17. As an example of the "game execution process in a limited function mode", the CPU 1 performs control to permit the music game to be played only with limited functions, by, for example, inhibiting use of a function of downloading a corresponding music piece data set from the server computer on the communication network X, inhibiting use of the performance guide function for guiding, in accordance with a progression of the music piece, the user or human player of the electronic musical instrument as to individual keys or other performance operators to be operated, allowing the user to play the music game only with a simple music piece or simplified level, displaying only a simplified music game screen on the display, etc.

The embodiments of the music game processing have been described as performing any one of the operations for executing the music game (step S4 of FIG. 3), for not executing the music game (step S6 of FIG. 3) and for executing the music game in the limited function mode (step S16 of FIG. 4), depending on whether or not the identifier (response signal) received from the electronic musical instrument 10 connected with the game apparatus PC matches any one of the prestored given identifiers, i.e. whether or not the connected electronic musical instrument 10 is a product manufactured by the same company as the music game or of a given model. However, the present invention should not be construed as limited to the described embodiments. For example, in the present invention, any one of the following stepwise operations may be carried out in accordance with the kind of the received identifier (response signal). Namely, when the received identifier indicates that the connected electronic musical instrument 10 is a product of one of the given models manufactured by the same company as the music game, the music game may be executed in the full function mode. When the received identifier indicates that the connected electronic musical instrument 10 is a product manufactured by the same company as the music game but of a model other than the given models, the music game may be executed in the limited function mode. When the received identifier indicates that the connected electronic musical instrument 10 is a product manufactured by a company other than the manufacturing company of the game apparatus PC, the music game may be prevented from being executed.

It should also be appreciated that the music piece data to be used for the music game may be in any desired format, such as: the "event plus absolute time" format where the time of occurrence of each note event is represented by an absolute time within the music piece or a measure thereof, the "event plus relative time" format where the time of occurrence of each note event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of a note event.

Reproductive performance processing of the music piece data used during the execution of the music game (i.e., updating of the music game screen during the execution of the music game) may be effected in any desired manner, such as by changing a processing period in accordance with a set performance tempo, changing a timing data value in the music piece data in accordance with the set performance tempo with the processing period fixed, or changing a manner of counting the timing data in the music piece data per execution of the processing in accordance with the set performance tempo with the processing period fixed.

In summary, the present invention arranged in the above-described manner can automatically determine whether an electronic musical instrument connected with a music application apparatus is of a particular manufacturing company (or particular model) and compliant with a music application to be executed by the music application apparatus, or of another manufacturing company than the particular manufacturing company (or other model than the particular model) and non-compliant with music application to be executed. Thus, the present invention allows a music application to progress differently between the case where an electronic musical instrument of the particular manufacturing company (or particular model is connected with the music application apparatus and the case where an electronic musical instrument of another manufacturing company or another model is connected with the music application apparatus. As a result, the present invention advantageously achieves a sufficient differentiation between electronic musical instruments of a particular manufacturing company and other manufacturing company (or of the particular model and other model).

What is claimed is:

1. A music application apparatus interactively operable by being connected with an electronic musical instrument, said music application apparatus comprising:

a transmission/reception section that transmits a predetermined identification request signal to the electronic musical instrument connected with said music application apparatus and receives a response signal returned by the connected electronic musical instrument in response to the predetermined identification request signal;

a determination section that determines, on the basis of the response signal received by said transmission/reception section, whether or not the connected electronic musical instrument is of a predetermined identity; and a control section that causes the music application to progress normally in response to performance-operator-operation-related information given by the connected electronic musical instrument when said determination section has determined that the connected electronic musical instrument is of the predetermined identity, but causes the music application to progress only in a limited function mode when said determination section has not determined that the connected electronic musical instrument is of the predetermined identity.

2. A music application apparatus as claimed in claim 1 wherein the music application is an application software providing a music game, music lesson or musical production.

3. A music application apparatus as claimed in claim 1 which includes a processing unit equipped with a music application software.

4. A music application apparatus as claimed in claim 3 which is in the form of a personal computer, electronic game apparatus, portable phone, mobile terminal, karaoke apparatus or other multimedia equipment.

5. An electronic musical instrument interactively operable by being connected with a music application apparatus, said electronic musical instrument comprising a response section that, when a predetermined identification request signal is received from the music application apparatus, returns a response signal indicative of a preset identity of said electronic musical instrument to the music application apparatus, wherein that said electronic musical instrument is of a predetermined identity is an essential condition for determining whether a music application should progress normally on the music application apparatus or should be progress only in a limited function mode.

6. An electronic musical instrument as claimed in claim 5 which further comprises:

a performance operator unit;

a transmission section that transmits, to the music application apparatus, operation-related information generated in response to operation on said performance operator unit;

a reception section that receives performance information supplied by the music application apparatus; and a tone generator section capable of generating a tone corresponding to the performance information received via said reception section.

7. An electronic musical instrument as claimed in claim 5 wherein the response signal includes unique identifier information indicative of a manufacturing company or model of the electronic musical instrument.

8. A program embodied on a device readable medium and executable by a processor for controlling an operating condition of a music application in a music application apparatus interactively operable by being connected with an electronic musical instrument, said program comprising:

a transmission/reception step of transmitting a predetermined identification request signal to the electronic musical instrument connected with the music application apparatus and receiving a response signal returned by the connected electronic musical instrument in response to the predetermined identification request signal;

a determination step of determining, on the basis of the response signal received by said transmission/reception step, whether or not the connected electronic musical instrument is of a predetermined identity; and a step of causing the music application to progress normally in response to performance-operator-operation-related information given by the connected electronic musical instrument when said determination step has determined that the connected electronic musical instrument is of the predetermined identity, but causes the music application to progress only in a limited function mode when said determination step has not determined that the connected electronic musical instrument is of the predetermined identity.

9. A program embodied on a device readable medium and executable by a processor for controlling an operating condition of a music application in an electronic musical instrument interactively operable by being connected with a music application apparatus, said program comprising:

a step of receiving a predetermined identification request signal from the music application apparatus; and a step of returning a response signal indicative of a preset identity of the electronic musical instrument to the music application apparatus, wherein the preset identity of the electronic musical instrument as indicated by the response signal is an essential condition for determining whether the music application shall progress normally on the music application apparatus or whether it shall progress in a limited function mode.

* * * * *